United States Patent [19]

Overfield

[11] Patent Number: 4,643,821

[45] Date of Patent: Feb. 17, 1987

[54] INTEGRATED METHOD FOR EXTRACTING NICKEL AND VANADIUM COMPOUNDS FROM OILS

[75] Inventor: Robert E. Overfield, Washington, N.J.

[73] Assignee: Exxon Research and Engineering Co., Florham Park, N.J.

[21] Appl. No.: 783,040

[22] Filed: Oct. 2, 1985

Related U.S. Application Data

[63] Continuation-in-part of Ser. No. 755,089, Jul. 15, 1985.

[51] Int. Cl.[4] ..... C10G 17/00; C10C 3/00

[52] U.S. Cl. ..... 208/251 R; 208/309

[58] Field of Search ..... 208/251 R, 309

[56] References Cited

U.S. PATENT DOCUMENTS

| | | | |
|---|---|---|---|
| 2,109,895 | 3/1938 | Anderson | 208/309 |
| 2,189,844 | 2/1940 | Starr et al. | 208/309 |
| 2,226,092 | 12/1940 | Clarke | 208/309 |
| 2,228,507 | 1/1941 | Cook | 208/309 |
| 2,310,524 | 2/1943 | Henry et al. | 208/309 |
| 2,587,643 | 3/1952 | Myers | 208/309 |
| 2,846,358 | 8/1958 | Bieber et al. | 208/251 R |
| 2,847,353 | 8/1958 | Beavon | 208/309 |
| 2,906,693 | 9/1959 | Donaldson | 208/251 R |
| 2,913,394 | 11/1959 | Kimberlin, Jr. et al. | 208/87 |
| 3,018,228 | 1/1962 | Cornell | 202/39.5 |
| 3,053,759 | 9/1962 | Harvey | 208/251 R |
| 3,162,595 | 12/1964 | Szepe | 208/251 R |
| 3,349,028 | 10/1967 | Burch | 208/251 R |
| 3,779,895 | 12/1973 | Wilson et al. | 208/251 R |
| 3,779,896 | 12/1973 | Woodle | 208/309 |
| 4,125,458 | 11/1978 | Bushnell et al. | 208/309 |
| 4,348,314 | 9/1982 | Lazarus et al. | 525/439 |
| 4,493,765 | 1/1985 | Long et al. | 208/309 |

OTHER PUBLICATIONS

C. Hansen & A. Beerhower, Kirk-Othmer Encyclopedia of Chem. Tech., 2nd Ed., Suppl., pp. 889-910, 1968.

*Primary Examiner*—Andrew H. Metz
*Assistant Examiner*—Helane Myers
*Attorney, Agent, or Firm*—E. Thomas Wheelock

[57] ABSTRACT

This invention is an integrated process for removing nickel and vanadium metalloporphyrinic compounds from oils which contain them and regenerating the solvent used to extract those metal compounds. The process involves the extraction of those compounds using certain solvents which are not miscible with the oils involved and which preferably are defined using variables known as three-dimensional solubility parameters. The solvents are regenerated for recycle to the extraction step. The most preferred solvents which meet the disclosed criteria are ethylene carbonate, propylene carbonate, ethylene trithiocarbonate and dimethylsulfone. The process is particularly suitable for removing the nickel and vanadium compounds from heavier oils such as crude oils and the so-called gas oils obtained during the early stages of the refining process.

20 Claims, 1 Drawing Figure

INTEGRATED METHOD FOR EXTRACTING NICKEL AND VANADIUM COMPOUNDS FROM OILS

RELATED APPLICATIONS

This application is a continuation-in-part of U.S. application Ser. No. 755,089, filed July 15, 1985 by the same inventor; the entirety of which is incorporated by reference.

FIELD OF THE INVENTION

This invention is an integrated process for removing nickel and vanadium metalloporphyrinic compounds from oils which contain them and regenerating the solvent used to extract those metal compounds. The process involves the extraction of those compounds using certain solvents which are not miscible with the oils involved and which preferably are defined using variables known as three-dimensional solubility parameters. The solvents are regenerated for recycle to the extraction process. The most preferred solvents which meet the disclosed criteria are ethylene carbonate, propylene carbonate, ethylene trithiocarbonate and dimethylsulfone. The process is particularly suitable for removing the nickel and vanadium compounds from heavier oils such as crude oils and the so-called gas oils such as vacuum gas oils and deasphalted oils.

BACKGROUND OF THE INVENTION

When broken down to the basics, a modern refinery has the overall function of taking a naturally-occurring material—crude oil—and creating a multitude of other more directly useful products such as gasoline, kerosene, lubricating oils and the like. The refinery accomplishes its purpose by two major operations: separation of hydrocarbons and by conversion of hydrocarbons.

The separations may merely remove one particular kind of hydrocarbon from a mixture; for instance, kerosene is simply distilled from crude oil. Or the separation may remove an undesirable material from other useful materials; for instance (as in the current invention), a metal-containing compound may be separated from other oils.

The other generic function of the refinery is the conversion of hydrocarbons. This may entail changing the type of or the molecular weight of the oil. For instance, the catalytic reforming process begins with a hydrocarbon feedstock which is largely made up of straight-chain hydrocarbon molecules (e.g., alkanes such as hexane) and converts them into materials which are closed chains (e.g., aromatics such as benzene or xylene). Aromatics tend to make higher-octane gasolines than the reformer feedstocks. Alternatively, the refinery process may change the size of the hydrocarbon molecule. Catalytic cracking involves the use of a catalyst to break or "crack" larger oil molecules into smaller molecules suitable for use in final products such as gasoline. Cracked materials may also be used as feedstocks to other refinery processes.

However, the overall refining process is not a static one. Market forces make demands on the products required of the refinery and also define the types of crude oils available as feedstocks to the refinery. Over the past dozen years, various conservation measures have changed the amount of gasoline needed in the marketplace. The requirement in the U.S. that lead compounds be substantially removed from gasoline sold for use in automobiles has caused similar massive changes in the way gasoline is produced. The decreasing availability of so-called "light" crude oils, those which typically contain less tar-like materials and sulfur-bearing compounds, has led to the major redesign of many refineries in the U.S. to allow use of the more-available heavier oils.

The use of heavier oils has had several immediate and clear consequences in the overall refinery process. First of all, the heavier oils contain certain contaminants not as prevalent in the lighter oils. These contaminants include sulfur and nitrogen compounds as well as metal-bearing compounds such as the nickel and vanadium contaminants removed by the present invention. As an additional result of the heavy crude use is the increased emphasis on refinery processes which convert heavier hydrocarbons to smaller and more useful ones. A complicating factor is that a substantial number of the additional contaminants are harmful to the catalysts used in the now more important conversion processes.

The metal vanadium, in particular, tends to deposit on the catalytic cracking catalyst and tends to increase both the production of coke (which coats portions of the catalyst rendering it less useful) and the production of hydrogen. Hydrogen is not generally seen as a useful end product. Vanadium also attacks the cracking catalyst itself, in particular the active zeolite portion of the catalyst, apparently as a migrating vanadium oxide material.

Both nickel and vanadium-bearing compounds are additionally undesirable if left in the refinery products which are separated, or distilled, from crude feedstocks. Fuel oils containing these metals may be harmful to fired boilers. The vanadium and nickel compounds create corrosive and persistent deposits in the cool ends of the boilers. The deposits often must be removed by hand.

In any event, processes which remove the nickel and vanadium compounds present in crude oils (for its various fractions) are clearly becoming more desirable.

The methods used in the past included one in which the oil was treated with a non-oxidizing acid such as hydrogen chloride. The metals in the oil precipitated in the form of an "acid sludge". The treated oil was then separated from the sludge, neutralized and fractionated to remove lower boiling constituents. The remaining fraction containing quantities of nickel and vanadium was then catalytically cracked and the spent catalyst (containing large concentrations of nickel and vanadium) was demetallized by extraction before being recycled to the cracking stage.

The metals in many of the heavier oil fractions have been found to be present in the form of low molecular weight chelates, particularly as metalloporphyrins. It is said that these metals may be removed by extraction with physical solvents such as gammabutyrolactone, acetonitrile, phenol, furfural, 2-pyrrolidinones, dimethyl sulfoxide, dimethylformamide, and pyridine-water mixtures. Gammabutyrolactone is said to be the best among these prior art solvents in respect to selectivity for vanadium and nickel. *See,* U.S. Pat. No. 2,913,394 by C. N. Kimberlin and W. J. Mattox.

The present invention may utilize the prior art solvents noted above in the metal extraction step or, more preferably, certain polar solvents which are superior to gammabutyrolactone when used as solvents for extraction of vanadium and nickel metalloporphyrinic compounds from oils. Among the solvents which are among those preferred are ethylene carbonate, propylene carbonate, ethylene thiocarbonate and dimethyl sulfone. The solvents are regenerated either by the step of extracting the metal-containing compounds with a highly aromatic oil or by extracting the metal-containing compounds with a highly aromatic oil while cooling the back-extraction step.

Certain of these solvents, of course, have other uses. As is shown in U.S. Pat. No. 4,348,314, ethylene carbonate is used as a specialty solvent for polymers. As is further shown in U.S. Pat. No. 3,018,228, it has also been used for aromatics extraction and the synthesis of pharmaceuticals. U.S. Pat. No. 3,912,801 discloses the extraction of a number of metal-bearing compounds from acid aqueous media using an alkylene carbonate.

None of the known prior art shows an integrated process for the separation of nickel and/or vanadium bearing metalloporphyrinic compounds from oils by using the specified solvents and regenerating those solvents for recycle to the metal extraction step.

SUMMARY OF THE INVENTION

The present invention generically is an integrated method for extracting vanadium and/or nickel-containing materials from oils containing those materials by use of certain solvents and regenerating that solvent for additional extraction. The solvent used may be selected from the group consisting of gammabutyrolactone, acetonitrile, phenol, furfural, 2-pyrrolidinones, dimethylsulfoxide, dimethylformamide, pyridine-water mixtures, ethylene carbonate, propylene carbonate, ethylenetrithiocarbonate, and dimethyl sulfone. Preferred solvents include one or more having a selected range of solubility parameter components. The components consist of $\delta_d$, the component arising from dispersion forces; $\delta_p$, the component arising from dipole coupling forces or polarity; and $\delta_h$, the component arising from hydrogen bonding forces. The ranges of solubility parameter components are 8.7 to 10.0 for $\delta_d$; 8.6 to 10.7 for $\delta_p$; and 0 to 6 for $\delta_h$. Specifically preferred solvents having solubility parameters within these limits are ethylene carbonate, propylene carbonate, ethylene trithiocarbonate and dimethyl sulfone.

These solvents are contacted with an oil containing the nickel- or vanadium-containing materials. Two phases are formed; a lower solvent extract phase containing the vanadium and nickel compounds (usually in the form of the metalloporphyrin) and an upper less dense oil phase substantially depleted in vanadium and nickel. The two phases are then separated.

The weight ratio of liquid solvent to oil should be at least 0.1:1 and the extraction is preferably carried out at elevated temperatures, that is, between 80° C. and 200° C. Dimethyl sulfone exists as a solid between 80° C. and 110° C. and therefore the extraction is carried out at temperatures greater than 110° C. when using it as the solvent.

The solvent is regenerated by contacting it with an oil which is of a highly aromatic nature and, optionally, by concurrently lowering the temperature below that of the extraction step. Suitable regenerant streams include a stream known as "cat cracker bottoms" (the main fractionator bottom stream), vacuum residua, heavy vacuum gas oil and light vacuum gas oil. Cat cracker bottoms are clearly most preferred.

DETAILED DESCRIPTION OF THE INVENTION

Figure 1:
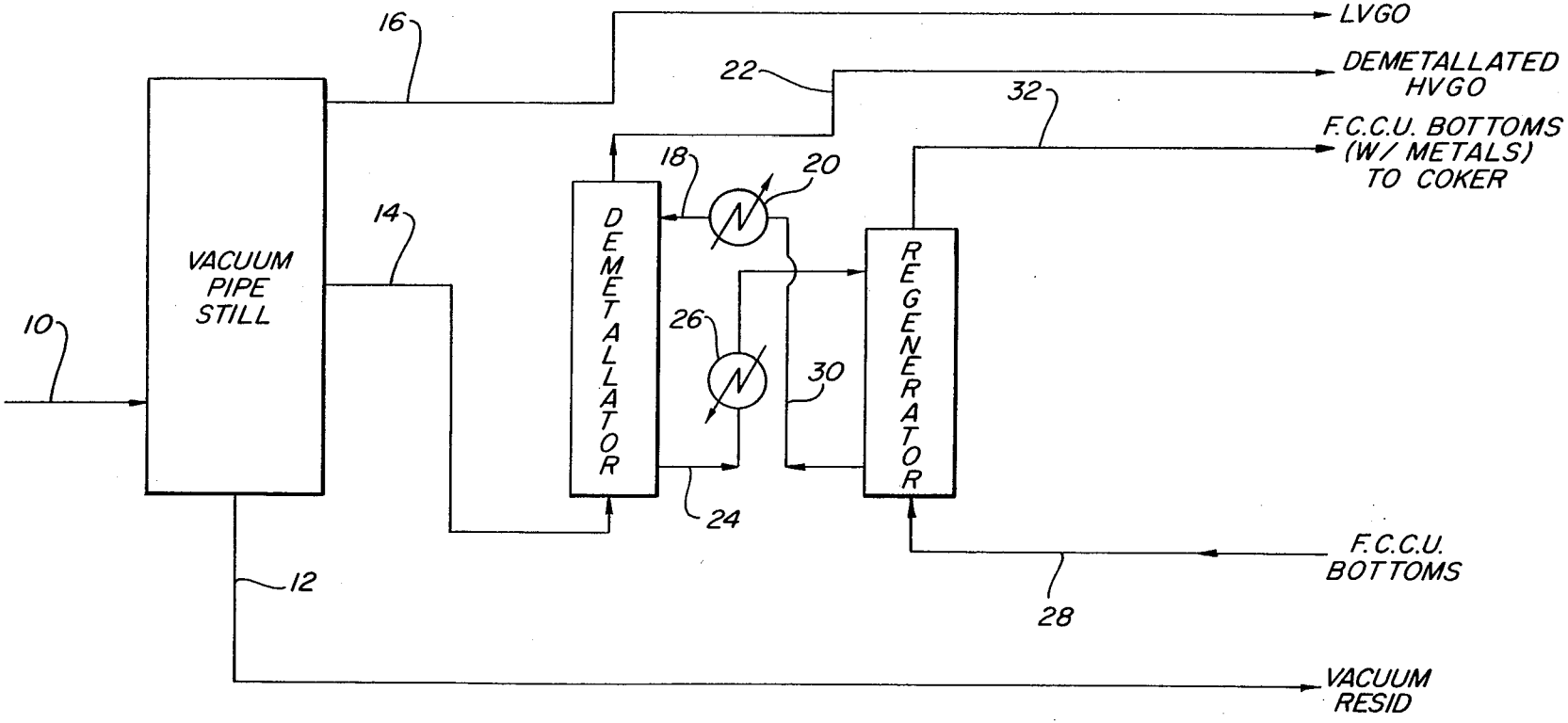
FIG. 1 is a schematic diagram of a suitable process for extracting the metals according to the invention and regenerating the solvent.

As noted above, this invention is an integrated process for extracting nickel and/or vanadium metalloporphyrinic containing materials from oils by solvent extraction and then regenerating the solvent.

1. Selection of Preferred Solvents

According to liquid solution theory, the free energy of a solute is at its smallest value in a solution having a like solubility parameter. The solubility parameter is the cohesive energy density of the solution, and is defined by the square root of the ratio of the energy of vaporization and the molar volume as shown by Equation (1):

$$\delta = \sqrt{\frac{E_{vap}}{V_m}} \quad (1)$$

The unit of the solubility parameter is $(cal/cm^3)^{\frac{1}{2}}$ and is determined at room temperature. The solubility parameter may be expressed as the sum of several individual contributions or "components". These components arise from dispersion forces ($\delta_d$), dipole coupled forces or polarity ($\delta_p$), and hydrogen bonding forces ($\delta_h$) between solution molecules. The sum of the squares of these three components is equal to the square of the overall solubility parameter $\delta$ as indicated in Equation (2):

$$(2)\delta^2 = \delta d^2 + \delta p^2 + \delta h^2$$

Solubility parameters may be found by consulting published tables or by following standardized procedures. *See,* C. Hansen and A. Beerhower, Kirk-Othmer Encyclopedia of Chemical Technology, 2nd Edition, Suppl. pp. 889–910. The dispersive component, $\delta_d$, can be determined by the solubility parameter of a solvent's homolog, i.e., in a hetero-organic solvent by a corresponding molecule with carbon replacing the heteroatoms. The dipole component, $\delta_p$, is measured from the dielectric constant and the index of refraction of the solvent. The correct overall component may be determined from vapor pressure-temperature data. The hydrogen bonding solubility parameter is obtained by difference by substituting the values of the individual components in Equation (1).

Each of the three-dimensional solubility parameters components $\delta_d$, $\delta_p$, and $\delta_h$, may be determined for a particular solvent candidate for the extraction of vanadium and nickel from oils. If the solvent has a $\delta_p$ of from 8.6 to 10.7, a $\delta_d$ of from 8.7 to 10.0 and a $\delta_h$ of from 0.0 to 6.0, it is considered a superior solvent for the extraction at temperatures of between 80° C. and 200° C. Solvents such as gammabutyrolactone, furfuraldehyde, dimethyl sulfoxide, dimethyl formamide, acetonitrile and 2-pyrrolidone, which have heretofore been described as good solvents for vanadium and nickel extraction, however, all show solubility parameters which fall outside these ranges.

The preferred solvents have the following solubility parameter components.

| Solvent | αd | αp | αh |
|---|---|---|---|
| Ethylene Carbonate | 9.5 | 10.6 | 2.5 |
| Propylene Carbonate | 9.8 | 8.8 | 2.0 |
| Dimethyl Sulfone | 9.3 | 9.5 | 6.0 |
| Ethylene Trithiocarbonate | — | — | — |

It has been found that temperature is an important factor in the determination of the optimum three-dimensional solubility parameter. For example, gammabutyrolactone which has been known in the art as a good extraction solvent for the extraction of vanadium and nickel from oils containing them shows a marked decrease in selectivity for vanadyl porphyrins as the temperature increases, and the values of the individual solubility parameter components for gammabutyrolactone also fall outside the range of values for such components according to the invention. The selectivity of ethylene carbonate, on the other hand, which is a solvent which meets the solubility criteria herein, shows no decrease in selectivity with temperature.

The preferred liquid extraction solvents which may be used in this invention are ethylene carbonate, propylene carbonate, ethylene trithiocarbonate and dimethyl sulfone. All show higher selectivity for vanadyl porphyrins than for the other components found in oils.

Ethylene carbonate, the most preferred polar solvent herein, has the chemical formula $C_3H_4O_3$ and the chemical structure:

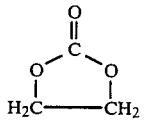

It has certain physical properties which make it a good extraction solvent in that it has relatively high boiling point (238° C.), and a high density, 1.32 g/cc which allows rapid settling during extraction. Because of the differences in density, the settling should be quick and complete in almost any extraction equipment.

2. Other Suitable Solvents

In addition to the preferred solvents, others which may be used in this invention include gammabutyrolactone, acetonitrile, phenol, furfural, 2-pyrrolidinone, dimethylsulfoxide, dimethylformamide, and pyridine water mixtures.

3. Metal Extraction Step

The oil and solvent may be contacted by employing counter-current extraction techniques known in the art. Generally the weight ratio of solvent to oil should be at least 0.1:1 and preferably at least 1:1. The solvent, typically being more dense, separates as a lower phase with the oil forming the upper phase. The extraction should be conducted at elevated temperatures, preferably between about 80° C. and about 200° C. Since dimethyl sulfone has a melting point of 110° C. temperatures between about 110° C. and 200° C. should be employed when it is used as the extraction solvent. By employing ethylene carbonate as the extraction solvent, there is also less solubilization of oil than with gammabutyrolactone and ethylene carbonate shows better selectivity than gammabutyrolactone.

The oils upon which this invention may be practiced include, of course, any oil which contains the offending metal contaminants. Practically speaking, however, to limit the volume of oil treated in a particular refinery, the process need be practiced only on the heavier streams. The metal-containing compounds are generally concentrated in those streams. They include those oils identified by the generally accepted nomenclature of atmospheric residual oil (atmospheric resid), vacuum residual oil (vacuum resid), deasphalted oil (DAO), vacuum gas oil (VGO), and the like. Certain crude oils represent special problems during refining and the distillation residues of these crudes are known by special acronyms, e.g., heavy Arabian atmospheric residual oil (HAR) and heavy Arabian vacuum residual oil (HAVR).

4. Regeneration Step

The above-described solvents form a solution with the metalloporphyrins during the extraction step. To reuse the solvent, the metalloporphyrins must be removed by some form of regeneration. This is conventionally accomplished by distilling or flashing off the solvent. In this invention, the tendency of the metalloporphyrin to form complexes with certain molecules is utilized. The metalloporphyrin-rich solvent stream is contacted with a regenerant immiscible oil stream containing oil molecules which tend to form complexes with the metalloporphyrins. This competes with the tendency of the solvent stream to form solutions and pulls the metalloporphyrins out thereby regenerating the solvent stream. The regenerant oil stream contains at least a minor amount of a highly aromatic oil. The solvent regeneration step may also entail lowering the temperature of the solvent-metalloporphyrin stream below that of the absorption step and thereby disfavor solution.

The temperature differential between the extraction step and the regeneration step, depending upon economics of operation and the solvent utilized, may range up to about 125° C. This cooling process may take place as a separate step practiced upon the solvent-porphyrin stream after it exits the absorption step or it may take place concurrently, e.g., in the same vessel, as with the back-extraction portion of the regeneration process.

The highly aromatic oil used in regenerating the solvent and forming the oil-porphyrin complex is one in which multiple aromatic rings are found in the oil. Hydrocarbon streams found in refineries are seldom made up of a single compound. The exceptions are the streams containing lighter materials, e.g., propane, butane, isobutane, etc. The oil streams to be used as back-extractants typically contain hundreds of identifiable compounds. Those that operate the best on the selected solvents contain more than about 25 molar percent of compounds with 4 or more aromatic rings. In refinery terminology, these oils would be known as cat cracker bottoms (the bottoms from a cracker main fractionator), coker fractionator bottoms, vacuum residua, heavy vacuum gas oil ("HVGO"), and light vacuum gas oil ("LVGO"). HVGO and LVGO are usually unreacted distillates from the pipe stills. Because it often contains more than 40% 4+ aromatic rings and contains no nickel or vanadium metals, the cat cracker bottoms oil is a highly desirable back-extractant.

The back extractant oil is typically of lower value than the stream from which the metals were removed and its ultimate disposition does not require that it be free of metals. It may be used in amounts as low as 1 part back-extract to 25 parts solvent. It may be used as-is or in a dilution of more than about 5% of another oil. For instance, a mixture of 10% by volume cat cracker bottoms and 90% HVGO does a superior job of removing the metalloporphyrins from the rich solvent.

5. The Integrated Process

One integrated process for extracting the metals and regenerating the solvent is shown in the FIGURE. In that diagram, an atmospheric residual oil (10) from an atmospheric pipestill is introduced into a vacuum pipestill where it is separated into at least three streamms, vacuum resid (12), HVGO (14), and LVGO (16); other streams are not shown to simplify the presentation of the invention. The heaviest stream is the vacuum residual oil which leaves the bottom of the vacuum pipestill through line (12). A large portion of the nickel and vanadium porphyrins which enter the vacuum pipestill through line (10) finally end up in the vacuum resid. This stream is typically deasphalted or coked and the metals end up in asphalt or coke where they result in little, if any, harm.

The presence of metalloporphyrins in the HVGO stream (14) may be harmful to the catalytic cracking catalyst, as discussed above. Consequently, treating this smaller stream is an economic way to remove the portion of the metalloporphyrins which cause the most difficulty in post-pipestill processing.

The HVGO is introduced, desirably in countercurrent fashion, to a stream (18) of the lean solvent in an amount and at a temperature such as discussed above. The temperature may be adjusted by heating in an exchanger (20). Other alternative methods of heating are also suitable. The demetallated HVGO leaves the demetallator via line (22) and may be then introduced into a fluidized catalytic cracking unit (FCCU) with or without additional treatment, e.g., hydrotreating, etc.

The rich solvent containing the metalloporphyrins exits the demetallator via line (24) and may be cooled in exchanger (26). The cooled stream is introduced into the regenerator tower where it may be countercurrently contacted with one of the highly aromatic streams discussed above. The use of FCCU bottoms is shown in the FIGURE as entering the regenerator at line (28). The cooled porphyrin-rich solvent is stripped (or back-extracted) of the porphyrins by the FCCU bottoms and exits the regenerator through line (30) for heating in exchanger (20) and recycle to the demetallator device. The FCCU bottoms stream leaving the overhead of the regenerator through line (32) contains the nickel and vanadium porphyrins. A stream such as this might then be sent to a delayed coker. The metals would be ultimately found in the coke product.

Other variations of the regeneration process would be apparent to the skilled designer in this art. Different types of liquid-liquid contacting devices, alternative methods of heat control, etc. are considered to be within the scope of this invention.

In order to more fully describe the invention, the following examples are given. These examples are intended to be only illustrative and in no way limiting of the invention.

EXAMPLE 1

In this Example, the temperature dependence of the distribution coefficients for oil components was determined for physical solvent extraction of Heavy Arab Vacuum Resid (HAVR) boiling between 950°-1250° F. using various solvents. In this Example, several samples of a HAVR distillate containing about 36 ppm vanadium and about 4.6 ppm nickel were separately contacted at a 1:1 (w/w) treat ratio with each of ethylene carbonate, propylene carbonate, ethylene trithiocarbonate, dimethyl sulfone, and gammabutyrolactone. These steps were conducted in a separatory device allowing formation of separable top and bottom phases. Small aliquots were removed from both top and bottom phases at different temperatures varying from about 80° C. to 200° C., the top phase containing solvent-extracted metalloporphyrins.

All solvents showed higher selectivity for metalloporphyrins including vanadium and nickel metalloporphyrins than other oil components. Distribution coefficients increased in the following order: Saturates < 1-2 Ring Aromatics ≦ 3-5 Ring Aromatics ≦ 5-6 Ring Aromatics ≦ 6-7 Ring Aromatics ≦ Polars < Vanadyl porphyrins.

The ratio of the distribution coefficient for vanadyl porphyrins to that for 1-2 Ring Aromatics was calculated for each solvent as one quantitative measure of Selectivity. When compared at 150° C. these solvents exhibited the following order of selectivity: gammabutyrolactone < propylene carbonate = dimethyl sulfone < ethylene trithiocarbonate < ethylene carbonate.

The selectivities of the solvents are given below.

Selectivity for Vanadyl Porphyrins vs. 1-2 Ring Aromatics

| | Temperature (°C.) | | | | | |
|---|---|---|---|---|---|---|
| Solvent | 75 | 100 | 125 | 150 | 175 | 200 |
| Gammabutyrolactone | 54 | 28 | 16 | 18 | 3 | 1.0 |
| Ethylene Carbonate | 52 | 48 | 45 | 42 | 40 | 36 |
| Propylene Carbonate | 36 | 34 | 30 | 20 | 16 | 13 |
| Dimethyl Sulfone | —* | —* | 17 | 21 | 40 | 1.0 |
| Ethylene Trithiocarbonate | — | 42 | 31 | 29 | 11 | — |

*MP = 110° C.

EXAMPLE 2

This Example demonstrates that ethylene carbonate used as an extraction solvent for the 950°-1250° F. fraction of HAVR dramatically reduces the vanadium and nickel concentrations therein.

The 950°-1250° F. fraction of HAVR containing about 36 ppm vanadium and about 4.6 ppm nickel present as organic chelates was contacted with ethylene carbonate at a 1:1 (w/w) treat ratio. The bottom extract phase was drawn off and the same initial weight of fresh solvent was added. This was repeated seven times. The seven extract phases and the raffinate oil were dried in a vacuum oven to determine loadings. Analysis for vanadium was done by visible light spectroscopy. The results are shown in the table below.

| Extract Number | Vanadium in Raffinate = $V_{raff.}$ (ppm) | Vanadium in Extracted Oil = $V_{ext.}$ (ppm) | $V_{ext.}/V_{raff.}$ | Extract Yield (/wt. %) |
|---|---|---|---|---|
| 1 | 21 | 292 | 13.9 | 3.51 |
| 2 | 12 | 171 | 14.2 | 3.92 |
| 3 | 7.5 | 119 | 15.9 | 3.19 |
| 4 | 5.5 | 78 | 14.2 | 3.25 |
| 5 | 3.75 | 43 | 11.5 | 3.37 |
| 6 | 3.35 | 39 | 11.6 | 2.08 |
| 7 | 2.2 (Ni = 0.5) | 30 | 13.6 | 1.65 |
| overall | 2.2 | 125 | 57 | 20.9 |

The total vanadium was reduced from 36 to 2.2 ppm or 93.8%. The nickel was reduced from 4.6 to 0.5 ppm or 89%. The mass balance for the experiment was 102%. The raffinate yield was 79%. The separation also reduced the microcarbon residue of the oil from 8 to 5.8 according to Micro Conradson Carbon Residue (MCR) test. The MCR of the first extracted oil was 18.

The selectivity of the extraction may be quantitatively measured by the separation factor. The separation factor is defined as $\alpha$ where:

$$\alpha = \frac{\text{oil wt. in raffinate phase}}{\text{oil wt. in extract phase}} \cdot \frac{\text{metal wt. in extract phase}}{\text{metal wt. in raffinate phase}}$$

The separation factor was measured for each successive extraction and was found to average 16.5.

EXAMPLE 3

An extended vacuum gas oil from Heavy Arab Vacuum Resid (HAVR) which boiled in the atmosphere equivalent range 950°–1289° F. was extracted with gammabutyrolactone and with several of the preferred solvents to determine how the various components of the oil were distributed between between the immiscible phases. The vacuum gas oil was contacted with an equal volume of the following polar solvents in separate experiments at 95° C.; gammabutyrolactone, ethylene carbonate, propylene carbonate, and ethylene trithiocarbonate. After thorough mixing and settling overnight the two phases were sampled. The concentration of vanadyl porphyrin in each phase was measured from the Soret absorbance. The concentration of 1–2 Ring Aromatics in each phase was measured by High Pressure Liquid Chromatography (HPLC). The ratio of the metalloorphyrin concentration in the polar solvent phase to that in the oil phase is the "Vanadyl Porphyrin Distribution Coefficient". The Selectivity is the ratio of the Distribution Coefficient for vanadyl to the Distribution Coefficient for 1–2 Ring Aromatics. The vanadyl Distribution Coefficient for each solvent and the Selectivity for VOP against 1–2 Ring Aromatics in the oil at 95° C. is set forth in the Table below.

| Solvent | Vanadyl Porphyrin Distribution Coefficient | Selectivity of Vanadyl Porphyrin vs. 1–2 Ring Aromatics |
|---|---|---|
| Gammabutyrolactone | 1.9 | 29 |
| Ethylene Carbonate | 0.3 | 48 |
| Propylene Carbonate | 0.6 | 33 |
| Ethylene Trithiocarbonate | 2.2 | 31 |

Ethylene carbonate, propylene carbonate, and ethylene trithiocarbonate each show higher selectivity than gammabutyrolactone even though their vanadyl Distribution Coefficients may not be as high at 95° C.

EXAMPLE 4

This Example shows the relative affinity and selectivity of ethylene carbonate and gammabutyrolactone.

The 950°–1250° F. fraction of HAVR was extracted with three sequential portions each of ethylene carbonate at 80° C. at a ratio of HAVR fraction to solvent of 1:2 (w/w). The results of vanadium removal and raffinate yield are given in Table III.

TABLE III

| Solvent | % V Removal | Raffinate Yield |
|---|---|---|
| Gammabutyrolactone | 97 | 60 |
| Ethylene carbonate | 47 | 95 |

EXAMPLE 5

This example demonstrates that highly aromatic oils have greater affinity for metalloporphyrins than less aromatic vacuum gas oils. Three oil streams of increasing aromaticity were tested, a light vacuum gas oil, a heavy vacuum gas oil, and cat-cracker bottoms. The three oil samples were doped with vanadyl Etio-I porphyrin and then extracted with propylene carbonate at 75° C. The distribution coefficient, which is the ratio of concentration of vanadyl Etio-I porphyrin in the extract phase to that in the oil phase, was measured by optical absorbance spectroscopy. The heavy vacuum gas oil contained intrinsic vanadyl porphyrins and the contribution of these to the measured vanadyl Etio-I porphyrin levels was corrected for in a separate experiment without doping of this stream. The final results are shown in the Table below:

| Oil Stream | Vanadyl Etio-I Distribution Coefficient |
|---|---|
| Light Vacuum Gas Oil | 2.5 |
| Heavy Vacuum Gas Oil | 1.7 |
| Cat-cracker Bottoms | 1.0 |

This example shows that propylene carbonate extracts less metalloporphyrin when it is contacted with an oil of increasing aromaticity. It is, therefore, demonstrated that the more aromatic oils show higher affinity for metalloporphyrin.

EXAMPLE 6

This example demonstrates that metalloporphyrin dissolution into the preferred solvents increases with increasing temperature. A sample of distillate of Heavy Arab Vacuum Resid boiling from 950°–1289° F. atmospheric equivalent was contacted in turn with an equal weight of extraction solvent, thoroughly mixed, and allowed to separate into two phases. Small aliquots were taken for determination of the metalloporphyrin concentration in each phase by optical absorbance spectroscopy. The temperature was varied and the procedure repeated. The measured ratio of vanadyl porphyrin concentration in the extract phase to that in the oil phase (which is the distribution coefficient) is given below.

| | Distribution Coefficients For Vanadyl Porphyrins Temperature (°C.) | | | | | |
|---|---|---|---|---|---|---|
| | 75° | 100° | 125° | 150° | 175° | 200° |
| Gamma Butyrolactone | .23 | .31 | .40 | .41 | .70 | .77 |
| Ethylene Carbonate | — | — | .46 | .38 | 1.2 | 2.3 |
| Propylene Carbonate | .39 | .68 | .71 | .90 | .85 | 1.1 |
| Dimethyl Sulfone | * | * | .14 | .15 | .22 | — |
| Ethylene Trithiocarbonate | — | 2.5 | 2.2 | 2.4 | 2.6 | — |

MP = 110° C.

This example demonstrates that the extraction solvent typically forms a more favorable solution with the vanadyl porphyrin as the temperature is raised. This indicates that it is generally better to extract the metals at higher temperature and to back-extract them at comparatively lower temperature.

I claim as my invention:

1. A method for the extraction of vanadium or nickel metalloporphyrinic compounds from an oil containing such compounds comprising the step of contacting said oil with a solvent selected from the group of gammabutyrolactone, acetonitrile, phenol, furfural, 2-pyrrolidinones, dimethylsulfone, dimethylformamide, pyridine-water mixtures, ethylene carbonate, propylene carbonate, ethylene trithiocarbonate, and dimethyl sulfone to produce a solvent-metalloporphyrinic compound stream and a demetallated product oil stream, regenerating the solvent-metalloporphyrinic stream by contacting it with a highly aromatic oil stream.

2. The method of claim 1 wherein said contacting is conducted at temperatures between 80° C. and 200° C.

3. The method of claim 1 wherein said solvent is one or more selected from the group consisting of ethylene carbonate, propylene carbonate, ethylene trithiocarbonate and dimethyl sulfone.

4. The method of claim 1 wherein said oil is deasphalted oil.

5. The method of claim 1 wherein said oil is a vacuum gas oil.

6. The method of claim 1 wherein the weight ratio of said solvent to said vanadium or nickel-containing oil is at least about 0.1:1.

7. The process of claim 1 wherein the highly aromatic oil stream comprises an oil selected from HVGO, LVGO and cat cracker bottoms.

8. The process of claim 7 wherein the highly aromatic oil stream comprises cat cracker bottoms.

9. The process of claim 2 wherein the regeneration step is at a temperature of up to about 125° C. less than the temperature of the contacting step.

10. The process of claim 8 wherein the regeneration step is at a temperature of up to about 125° C. less than the temperature of the contacting step.

11. A method for the extraction of vanadium or nickel metalloporphyrinic compounds from an oil containing such compounds comprising the step of contacting said oil with a solvent having a $\delta_h$ of between 0 and 6, a $\delta_p$ of between 8.6 and 10.7 and a $\delta_d$ of between 8.7 and 10.00 to produce a solvent-metalloporphyrinic compound stream and a demetallated product oil stream, regenerating the solvent-metalloporphyrinic stream by contacting it with a highly aromatic oil stream.

12. The method of claim 11 wherein said contacting is conducted at temperatures between 80° C. and 200° C.

13. The method of claim 11 wherein said oil is a deasphalted oil.

14. The method of claim 11 wherein said oil is a vacuum gas oil.

15. The method of claim 11 wherein the weight ratio of said solvent to said vanadium or nickel-containing oil is at least about 0.1:1.

16. The process of claim 11 wherein the highly aromatic stream comprises an oil selected from HVGO, LVGO and cat cracker bottoms.

17. The process of claim 16 wherein the highly aromatic oil stream comprises cat cracker bottoms.

18. The process of claim 12 wherein the regeneration step is at a temperature of up to about 125° C. lower than the temperature of the contacting step.

19. The process of claim 17 wherein the regeneration step is at a temperature of up to about 125° C. lower than the temperature of the contacting step.

20. A method for the extraction of vanadium or nickel metalloporphyrinic compounds from an oil containing those compounds comprising the step of contacting said oil with ethylene carbonate wherein the weight ratio of ethylene carbonate to said oil is at least about 0.1:1 at temperatures between 80° C. and 200° C. to produce a rich solvent stream containing a majority of said metalloporphyrinic compounds and a demetallated oil stream, regenerating the rich solvent by cooling the stream up to about 125° C., and contacting the cooled rich solvent with cat cracker bottoms to regenerate the rich solvent.

* * * * *